United States Patent [19]

Gebauer

[11] 4,117,291

[45] Sep. 26, 1978

[54] REED SWITCH

[75] Inventor: Bodo G. Gebauer, Algonquin, Ill.

[73] Assignee: GTE Automatic Electric Laboratories Incorporated, Northlake, Ill.

[21] Appl. No.: 798,735

[22] Filed: May 19, 1977

[51] Int. Cl.[2] ..... H01H 1/02

[52] U.S. Cl. ..... 200/268; 200/269; 200/283; 335/196; 335/151

[58] Field of Search ..... 200/268, 269, 283

[56] References Cited

U.S. PATENT DOCUMENTS

| | | | |
|---|---|---|---|
| 2,379,641 | 7/1945 | Keitel | 200/263 |
| 2,600,175 | 9/1946 | Volterra | 200/270 |
| 3,249,728 | 5/1966 | Sasamoto et al. | 200/283 |
| 3,671,702 | 6/1972 | Penczek | 200/268 |
| 3,813,508 | 5/1974 | Toshiki et al. | 200/268 |
| 3,889,098 | 6/1975 | Steinmetz et al. | 200/268 |

*Primary Examiner*—J. V. Truhe
*Assistant Examiner*—J. H. Bouchard

[57] ABSTRACT

The cooperating contacts of a reed switch each comprise a layer of palladium. A protective layer of ruthenium deposited on the palladium layer prevents the formation of frictional polymers.

5 Claims, 3 Drawing Figures

REED SWITCH

BACKGROUND OF THE INVENTION

1. Field of the Invention

This invention relates to reed switches in general and in particular, to the structure of cooperating electrical contacts of a reed switch.

2. Description of the Prior Art

The use of palladium as a contact material is desirable since the costs of other platinum group metals such as rhodium are relatively expensive. However, one known problem which occurs when platinum group metals are employed as reed switch contacts is that of "frictional polymer" formation. Frictional polymers form on the surfaces of contacts formed from platinum group metals when the contact surfaces have been "activated" by exposure to organic vapors or liquids such that an organic film covers the contact surfaces and the activated surfaces are rubbed against each other. It is only with the greatest difficulty that an electrical contact may be fabricated from certain metals of the platinum metal group without the contact surface becoming activated because our atmosphere contains a multitude of organic vapors which instantaneously cover any object exposed to the atmosphere. Because of the magnetostrictive properties of switch reeds which support the contacts of a reed switch, the contact surfaces rub against each other whenever the switch is operated.

Previous solutions to eliminate the problem of polymer formation where platinum group metals such as palladium are employed, utilize a protective layer of gold over one of the contacts. Essentially this approach results in a dissimilar contact pair, i.e., a gold surface of one contact contacting a palladium surface of the other contact. Other dissimilar contact pairs are taught by U.S. Pat. No. 2,793,273 issued May 21, 1975, to K. C. Underwood et al; U.S. Pat. No. 2,379,641 issued July 3, 1945, to C. W. Keitel; and U.S. Pat. No. 2,300,286 issued Oct. 27, 1942, to C. B. Gwyn. Such dissimilar contact approaches require selective assembly techniques which are not compatible with established reed switch fabrication techniques.

Another approach employs a protective layer of gold over both of the contacts such as taught by U.S. Pat. No. 3,671,702 issued June 20, 1972, to E. S. Penczek. This approach is undesirable for reed switch applications since gold contact surfaces have a tendency to stick.

SUMMARY OF THE INVENTION

In accordance with the principles of the invention, a reed switch comprises cooperating electrical contacts wherein each contact comprises an inner layer of palladium and an outer layer of ruthenium.

Further, in accordance with the invention, cooperating contacts of a reed switch each comprise a first layer of gold on the switch reeds, an intermediate layer of palladium and an outer layer of ruthenium.

BRIEF DESCRIPTION OF THE DRAWINGS

The invention will be further described in detail by way of several examples in conjunction with the drawings in which.

EXAMPLE 1

Figure 1:
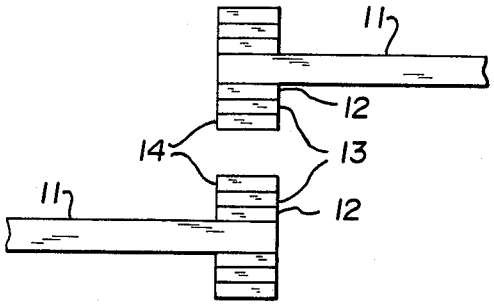
FIG. 1 shows one preferred embodiment of cooperating electrical contacts in accordance with the invention.
Figure 2:
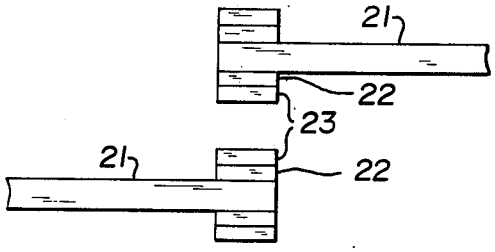
FIG. 2 shows a second preferred embodiment of cooperating electrical contact in accordance with the invention.

A pair of switch reeds 11 formed of a remanently magnetic material of a type commonly known as "remendur" were prepared for plating by cathodic cleaning in a 5 percent sulfuric acid bath maintained at room temperature. The reed ends were immersed in the bath to a depth of 0.325 inch for 2 minutes and the current density was 10 amperes/square foot.

Subsequent to the cathodic cleaning, the blades were rinsed with de-ionized water at room temperature for 1 minute. A layer 12 of gold 40 microinches thick, was electroplated onto the clean substrate. A technique known as pulse current plating was employed. This technique is known in the art and is noted in *Gold Plating Techniques*, F. H. Reed et al., Electrochemical Publications Limited, Scotland, 1974, at page 65.

A soft neutral gold plating bath was used having the following characteristics:

Gold: 7.8 to 8.6 grams/liter
Viscosity: 17° to 20° Baume'
Ph: 5.8 to 6.0
Temperature of the bath: 60° ± 2° C.

The tips of the reeds 11 were immersed in the above bath to a depth of 0.300 inches for 5 minutes, 30 seconds during which the following pulse plating parameters were maintained:

Peak current density: 11.5 amperes/sq.ft.
current pulsing: 9.6 milliseconds on, 44 milliseconds off.

The gold plated remendur was then rinsed in de-ionized water at room temperature for 1 minute.

A layer 13 of palladium was electroplated onto the gold layer by means of a commercially available plating bath formed from the palladium salt $Pd(NH_3)_2C2_2$. The bath was maintained at a temperature of 55° ± 2° C.

The ends of the reeds 11 were immersed into the bath to a depth of 0.200 inches for 16 minutes during which the following pulse plating parameters were maintained:

Peak current density: 13.8 amperes/sq.ft.
current pulsing: 1 millisecond on, 9 milliseconds off.

The palladium layer so obtained had a thickness of 25 microinches.

The palladium plating was followed by two rinses each for 1 minute with de-ionized water maintained at room temperature.

A layer 14 of ruthenium was then electrodeposited using conventional direct current plating by means of the following bath:

Ruthenium: 9–10 grams/liter as a complex of $(NH_4)_3[Ru_2NCl_5(H_2O)_2]$
Ph adjusted to: 1.115–1.5 by means of $H_2SO_4$
Temperature of the bath: 55° ± 2° C.
Current Density: 5 amp/ft$^2$.

The tips of the reeds 11 were immersed in the ruthenium bath to a depth of 0.100 inches for 11 minutes to obtain a ruthenium layer 13 having a thickness of 20 microinches. The reeds 11 were then rinsed for 1 minute with de-ionized water at room temperature.

EXAMPLE 2

A second pair of switch reeds 21 formed of remendur was also prepared for plating by cathodic cleaning and rinsing as described in example 1. However, instead of plating an underlayer of gold, a palladium layer 22 was pulsed current plated directly onto the substrate as described in Example 1 except that the duration of the plating was 41 minutes and the palladium layer had a thickness of 65 microinches. A ruthenium layer 23 having a thickness of 20 microinches, was then electroplated onto the palladium surface as described in Example 1.

Figure 3:
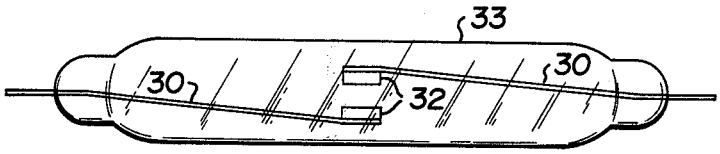
FIG. 3 illustrates a reed switch in accordance with the invention.

A pair of switch reeds having contacts formed in accordance with Example 1 and a second pair of switch reeds having contacts formed in accordance with Example 2 were each encapsulated in a glass envelope employing conventional reed switch encapsulation techniques. One such reed switch is shown in FIG. 3 which includes a pair of switch reeds 30 having contacts 32 disposed on the ends of the reeds and a glass envelope 33 encapsulating the reeds 30. The reed switches so formed were then cyclically operated. In addition, a reed switch having cooperating contacts of exposed palladium was also cyclically operated.

The contacts formed in accordance with Examples 1 and 2 showed no evidence of frictional polymer formation after 0.5 million dry switching operations. In contrast, contacts having exposed palladium surfaces after a like number of operations exhibited frictional polymers covering the entire contacting portions of the contact surfaces.

It is believed that a ruthenium layer prevents the palladium surface from becoming activated, i.e., covered with an organic film, and thus no polymer can be formed as a result of contact surface friction. The ruthenium layer, although a platinum group metal, does not enhance the formation of frictional polymer. The exposed surface of the ruthenium forms a conductive oxide, ruthenium dioxide, which is a stable material even under adverse atmospheric conditions such as high tempertures, high humidity and the presence of organic vapors.

Although the present invention has been described in conjunction with two preferred embodiments, it will be obvious to those skilled in the art that various changes and modifications may be made without departing from the spirit and scope of the invention.

What is claimed is:

1. A reed switch comprising a sealed envelope, a pair of switch reeds and a pair of cooperating contacts each disposed on a corresponding end of each of said switch reeds wherein each of said contacts comprises an inner layer of palladium and an outer layer of ruthenium including an exterior surface of an oxide of ruthenium.

2. A reed switch in accordance with claim 1 wherein said switch reeds comprise a remanently magnetic material.

3. A reed switch comprising a sealed envelope, a pair of switch reeds and a pair of cooperating contacts each of said contacts disposed on a corresponding end of each of said switch reeds and comprising an inner layer of gold, an intermediate layer of palladium, and an outer layer of ruthenium including an exterior surface of an oxide of ruthenium.

4. A reed switch in accordance with claim 3 wherein said inner layer of gold is pulse current plated onto the surface of the corresponding switch reed.

5. A reed switch in accordance with claim 3 wherein said switch reeds comprises a remanently magnetic material.

* * * * *